US008667998B1

(12) United States Patent
Westrick

(10) Patent No.: US 8,667,998 B1
(45) Date of Patent: Mar. 11, 2014

(54) WALLET FOR CARDS AND PAPER CURRENCY

(76) Inventor: Paul J. Westrick, Columbus, OH (US)

( * ) Notice: Subject to any disclaimer, the term of this patent is extended or adjusted under 35 U.S.C. 154(b) by 396 days.

(21) Appl. No.: 13/022,868

(22) Filed: Feb. 8, 2011

Related U.S. Application Data

(63) Continuation-in-part of application No. 29/357,297, filed on Mar. 10, 2010, now Pat. No. Des. 632,076.

(51) Int. Cl.
*A45C 11/18* (2006.01)

(52) U.S. Cl.
USPC ..... 150/147; 206/37

(58) Field of Classification Search
USPC ..... 150/132, 147–149, 900; 206/37–39, 206/39.5; 383/33
See application file for complete search history.

(56) References Cited

U.S. PATENT DOCUMENTS

| | | | | | |
|---|---|---|---|---|---|
| 1,230,100 | A * | 6/1917 | Blanchard | 206/37 |
| 1,670,343 | A * | 5/1928 | Clemens | 206/39.5 |
| 2,078,935 | A * | 5/1937 | Downes | 150/132 |
| 2,247,191 | A * | 6/1941 | Endres | 206/423 |
| 2,737,991 | A * | 3/1956 | Bass | 150/132 |
| 3,421,658 | A * | 1/1969 | Cooksey | 221/307 |
| 4,739,877 | A * | 4/1988 | Olson | 206/38.1 |
| 5,078,265 | A * | 1/1992 | Fugit et al. | 206/39.6 |
| 5,941,375 | A * | 8/1999 | Kamens et al. | 206/38 |
| 7,200,897 | B2 * | 4/2007 | Silvestro | 24/3.3 |
| D557,497 | S * | 12/2007 | Fedon et al. | D3/247 |
| D590,151 | S * | 4/2009 | Karobkina et al. | D3/247 |
| 2011/0272072 | A1 * | 11/2011 | Westover et al. | 150/147 |

* cited by examiner

*Primary Examiner* — Sue A Weaver
(74) *Attorney, Agent, or Firm* — Standley Law Group LLP

(57) ABSTRACT

A wallet (110) for holding a plurality of rectangular cards (C) has a sleeve (112) that is flattened into a rectangular profile. The sleeve is maintained in the rectangular profile by a shaping element (130) that is secured to an interior surface of the sleeve. The rectangular profile has a length and a width that are substantially the same as that of the cards intended on be held, the length being the larger of the dimensions. The sleeve is open along the width edges (20, 22) and closed along the length edges. Optionally, a strap (140) that passes across an exterior surface of the sleeve from one of the width edges to the other width edge, with its ends secured inside the sleeve, is useful for retaining folded paper currency and the like. The strap ends are secured to at least the shaping element.

18 Claims, 5 Drawing Sheets

WALLET FOR CARDS AND PAPER CURRENCY

CROSS-REFERENCE TO RELATED APPLICATIONS

This application is a continuation-in-part of, and makes a claim of priority to, U.S. design patent application Ser. No. 29/357,297, filed on 10 Mar. 2010, which issued as U.S. D632,076 on 8 Feb. 2011.

TECHNICAL FIELD

The disclosed embodiments of the present invention relate to a wallet that is configured for receiving and retaining a plurality of plastic cards, such as credit or debit cards, gift cards, identification cards and the like, as well as business cards and paper currency.

BACKGROUND OF THE ART

Stated generally, the design of the wallet has not accommodated the rapid change from a "cash" economy to a "cashless" economy, in which the average person carries less and less paper currency and more and more "plastic", in the nature of credit or debit cards, ID cards, gift cards, etc. As a result, the prior art wallet is simply not properly equipped to handle the purpose for which it is intended. This can particularly pose a problem when the user wishes to carry the wallet in a front pocket of the trousers rather than a hip pocket, as would be the case when one is in an area known for pickpockets.

It is also believed that carrying a large wallet in a hip pocket may have adverse effects on the back, so eliminating the conventional wallet in a hip pocket may ameliorate or prevent such problems.

It is therefore an unmet advantage of the prior art to provide a wallet configured to accommodate the mix of cards and currency carried in today's society.

SUMMARY OF THE INVENTION

This and other unmet advantages of the prior art are provided by a wallet for holding a plurality of rectangular cards. The wallet comprises a sleeve that is flattened into a rectangular profile having a length and a width with the length being larger than the width. The sleeve is open along the width edges and closed along the length edges. The wallet also comprises a shaping element that is secured to an interior surface of the sleeve for retaining the sleeve in the rectangular profile.

To achieve the shaping function, the shaping element has a width and length that approximate the width and length of the rectangular cards being held.

In some embodiments, the wallet further comprises a strap that passes across an exterior surface of the sleeve from one of the width edges to the other width edge. The ends of the strap are secured inside the sleeve. In many of these embodiments, the strap ends are secured to at least the shaping element, and, more particularly, to a means for securing the strap that is formed in the shaping element. In a more particular embodiment, the means for securing each of the strap ends comprises a shaped keyway in the shaping element and a correspondingly-shaped end of the strap.

In many embodiments, the sleeve comprises leather, while other embodiments have a sleeve comprising a fabric-backed foamed elastomer or another material.

In many embodiments, the sleeve comprises a thermoplastic elastomer.

In many embodiments, the wallet also comprises a means for interfering with transmission of radio frequency signals through the sleeve, incorporated in at least one of the sleeve and the shaping element.

In many embodiments, the sleeve is formed from a rectangular piece of flexible material that is folded onto itself such that a pair of opposing edges of the piece are secured in abutting relationship. In many of these embodiments, the opposing edges are held in the abutting relationship by an adhesive interposed between the shaping element and the flexible material at the abutting edges.

In some of the embodiments, the wallet further comprises a card retaining element having a tabbed end that extends outwardly from an open end of the sleeve.

BRIEF DESCRIPTION OF THE DRAWINGS

A better understanding of the disclosed embodiments will be obtained from a reading of the following detailed description and the accompanying drawings wherein identical reference characters refer to identical parts and in which.

DETAILED DESCRIPTION OF A PREFERRED EMBODIMENT

Figure 2:
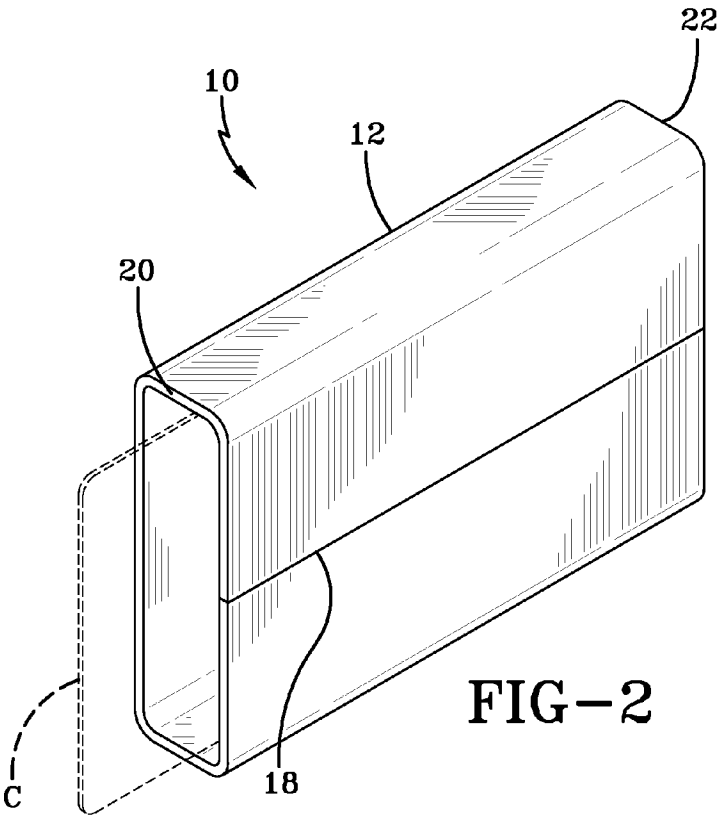
FIG. 2 is a rear perspective view of the FIG. 1 embodiment.
Figure 1:
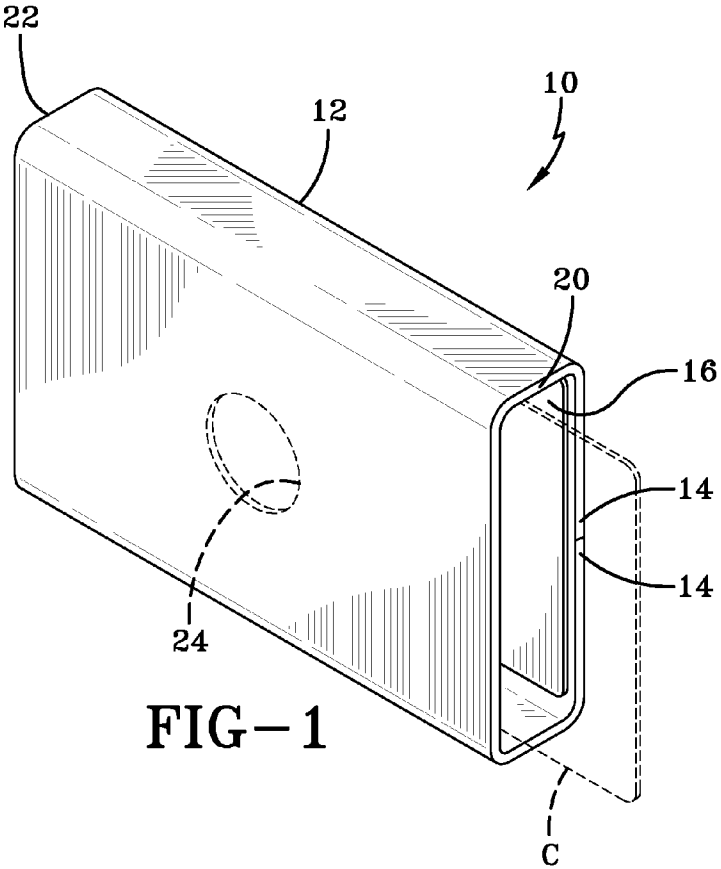
FIG. 1 is a front perspective view of a first embodiment of the wallet.

FIGS. 1 and 2 show front perspective and rear perspective views of a first embodiment 10 of a wallet. The wallet 10 is depicted here in its most basic configuration. In the depicted embodiment, a sleeve 12 is formed by folding a rectangular piece of leather, or another suitable flexible material, onto itself, so that the opposing edges 14 of the rectangular piece abut each other. In another embodiment, the sleeve is formed by cutting a length of a pre-formed tube of an appropriate material. As an example of an alternate material would be a fabric-backed foamed elastomer, especially a material such as is used commonly in manufacturing wetsuits. A particularly suitable alternate material would use a nylon fabric that backs a foamed neoprene elastomer. When this material is used, it is preferred to have the elastomer surface of the material to form the inside surface of the sleeve 12, with the fabric surface forming the outside surface of the sleeve. Other suitable materials, which will be known to those of skill in the art, include cork, textile and other natural and man-made materials.

In the situations where the sleeve 12 is formed from a rectangular piece of flexible material, the abutting edges 14 are secured in position relative to each other by conventional means. In the depicted embodiment 10, a sheet 16 bearing an adhesive surface is used to secure the edges 14 from the inside of the sleeve. In another known embodiment, the abutting edges 14 may be sewn together, although even in this embodiment, it is preferred to also adhesively secure a sheet 16 inside the sleeve 12 to provide shape to the sleeve by maintaining it in a generally flattened condition. In either of these cases, the abutting edges 14 form a seam line 18 that passes across the sleeve 12 from a first open end 20 to the second open end 22, and, due to the presence of the sheet 16, the seam line runs generally across a mid-line of a rear surface of the sleeve. Because of the shaping function, the sheet 16 will preferably be a rectangle with a width and length sized to simulate the width and length of the type of cards to be retained in the wallet 10.

In some embodiments, it may be useful to provide a wallet 10 that interferes with the ability to "read" magnetic strips or radio frequency ID (RFID) chips associated with the cards being carried. This provides a modicum of protection to the user from having the magnetic strips or RFID chips "hacked." This protection may be achieved, for instance, by using a sheet 16 with means for interfering with radio frequency transmission therethrough, such as metallic threads or a metallic foil. In these (as well as in other) aspects of the inventive concept, it may be useful to incorporate metallic threads or another radio-frequency blocking material into the sleeve 12 to safeguard the cards in the wallet from being read by an unauthorized party.

The sleeve depicted in FIGS. 1 and 2 is of a relatively thick size and, depending upon whether it is used with the optional strap feature described in more detail below, it can hold on the order of about ten plastic credit cards. As a point of reference, the size of a banking or identification card, as set by international standard ISO/IEC 7810:2003, is a length of 3.375 inches (85.60 mm), a width of 2.125 inches (53.98 mm) and a thickness of 0.76 mm. Conventional business calling cards are very similar in size, with a standard length of 3.50 inches and a width of 2 inches. In manufacturing the sleeve 12, the capacity is readily adjusted by small changes in the lengthy of the longer sides of the rectangular material. In general, the sleeve will be sized to hold from about two to about twelve standard banking cards. As business cards are much thinner, the same sleeve 12 would have a larger capacity for holding business cards. In some aspects of the invention, it may be desirable to produce a sleeve 12 that is slightly longer, so that the slightly longer business cards are received without extending out of the open ends 20, 22 of the sleeve.

FIGS. 1 and 2 show an exemplary credit card C, depicted in broken lining, inserted in the sleeve 12. As readily seen, the card C slides into the sleeve 12 through either one of its open ends 20, 22. While the design depicted in these figures shows a central aperture 24 in a front face of the sleeve 12, this aperture serves primarily an ornamental function provides minimal utility beyond allowing easy identification of the card positioned directly below.

Figure 4:
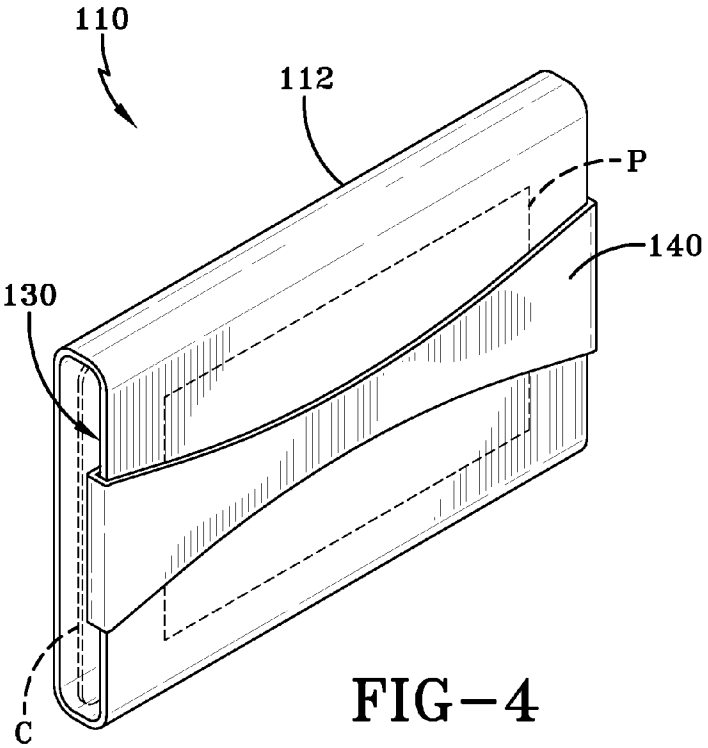
FIG. 4 is a rear perspective of the FIG. 3 embodiment.
Figure 3:
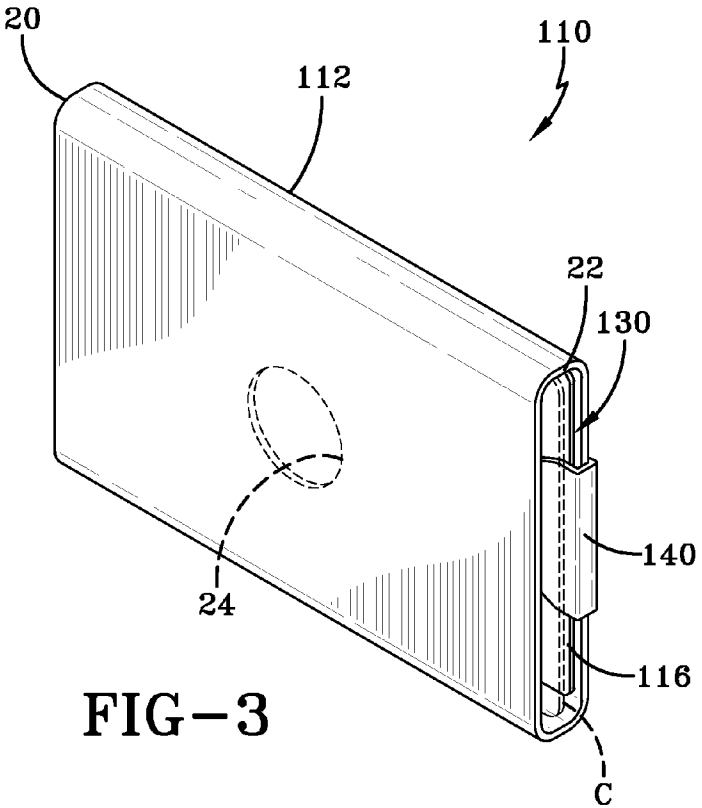
FIG. 3 is a front perspective view of a second embodiment, having a lower card capacity and including the optional strap feature.

Turning now to a second embodiment 110 of the wallet, FIGS. 3 and 4 depict this embodiment, which comprises a sleeve 112 and a strap assembly 130. Sleeve 112 is assembled in the same manner as sleeve 12 of FIGS. 1 and 2, although the addition of the strap hides the seam line on the rear surface of the sleeve. Wallet 110 is assembled from a "shorter" piece of material, so that it has a lower card capacity than wallet 10 of FIGS. 1 and 2.

The strap assembly 130 comprises two pieces: the strap 140 and a base 116, which serves the same purpose as sheet 16 of FIGS. 1 and 2, but also anchors the strap 140, which extends across the rear surface of the sleeve, especially along the obscured seam line. As in FIGS. 1 and 2, an exemplary credit card C is depicted in broken lining, as is a piece of folded paper currency P. Also, a central aperture 24 is depicted as in FIGS. 1 and 2.

Figure 5:
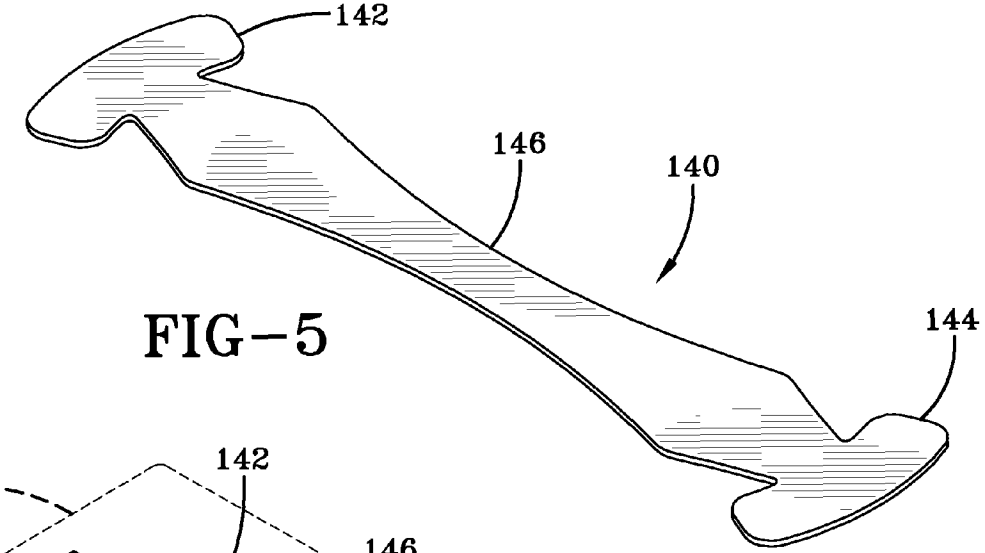
FIG. 5 is a perspective view of the optional strap feature, isolated from the wallet.
Figure 6:
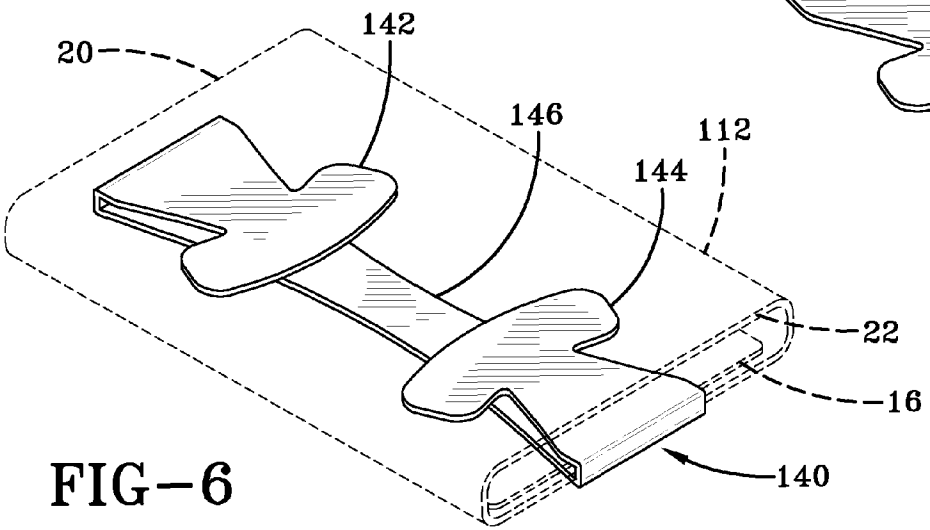
FIG. 6 is perspective view of the strap feature of FIG. 5, operatively engaged with the sleeve, which is depicted in broken lining.

Further details of the strap 140 can be seen in FIGS. 5 and 6. FIG. 5 shows a strap 140 in a preferred shape, isolated from the wallet. Strap 140 has first and second end portions 142, 144, connected by elongate portion 146. In the preferred embodiments, the elongate portion 146 narrows in width as the center is approached from either end. To provide the flexibility and limited amount of stretch that assists in retaining paper currency P or the like between the strap 140 and the rear surface of the sleeve 112, a preferred material for the strap is a thermoplastic elastomer, especially a cross-linked mixture of ethylene propylene diene monomer ("EPDM") rubber and polypropylene. Such a material is commercially available. Other elastomeric materials, including silicone-based materials or natural rubber materials will likely be very useful to one of skill in this application.

FIG. 6 shows the manner in which the strap 140, and particularly the ends 142, 144 thereof, is retained in place by the base 116 so that the elongate portion 146 extends across the rear surface of the sleeve 112. Although the structures on base 116 that enable the retention are not shown in FIG. 6, they are shown and described with reference to FIGS. 7 and 8.

Figure 7:
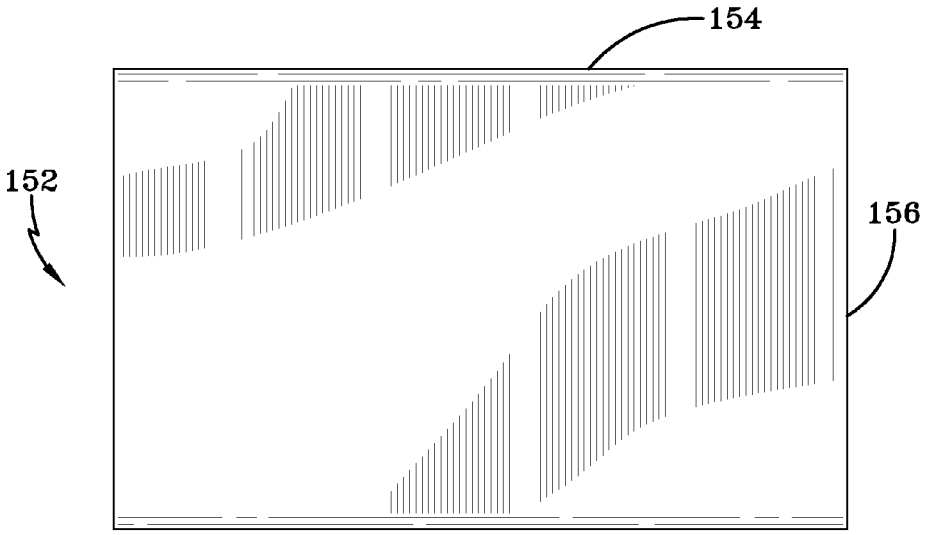
FIGS. 7 and 8 show in top plan view a rectangular portion and a second element that are used to form the base of the cash strap assembly.
Figure 8:
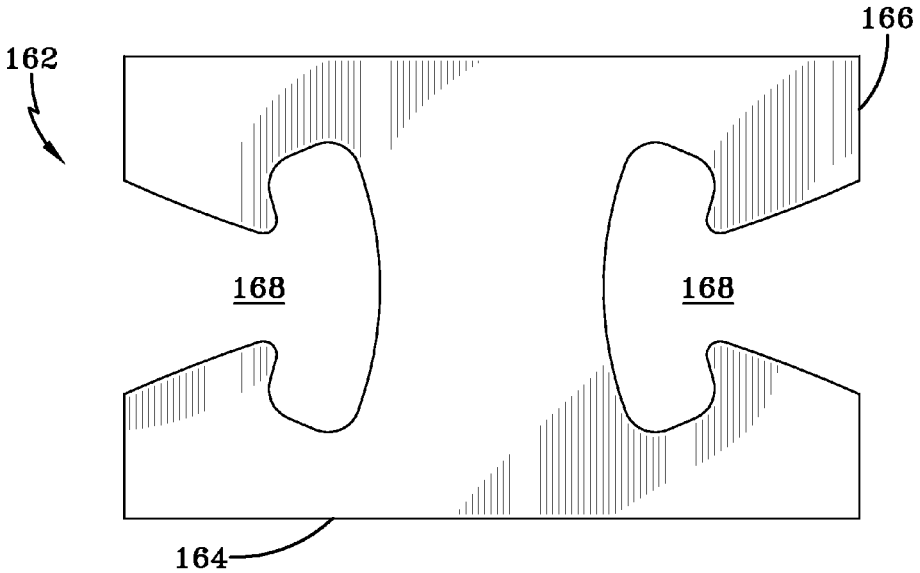

One manner of configuring the strap assembly is disclosed by FIGS. 7 and 8, which show two pieces for assembling the base 116 that is used for securing the strap 140. FIG. 7 is a top plan view of a rigid rectangular portion 152 which serves a shaping purpose identical to that of base 16, so it preferably has a length and width that is substantially identical to the dimensions of the type of card for which the sleeve is intended. In other words, when a wallet is being manufactured for use with credit cards, gift cards, identification cards and the like, the rectangular portion 152 will preferably be 3.375 inches on each of the longer sides 154 and 2.125 inches on each of the shorter sides 156, but if the wallet is being manufactured primarily with use in association with business cards in mind, the rectangular portion will preferably be 3.5 by 2 inches on the respective longer and shorter sides. Rigid rectangular portion 152 will be preferably cut or punched from a rigid and preferably thick stock material, especially a recycled leather, although a variety of materials possessing the necessary rigidity will be acceptable, including both natural and manmade materials. FIG. 8 shows a second element 162 that is combined with rectangular portion 152 to form the base 116. This second element 162 is generally rectangular and will have longer and shorter sides, 164, 166, that are identical to those of the rectangular portion 152 with which it is intended to be used. However, second element 162 is cut, punched or otherwise formed to have a pair of shaped apertures 168, each of which starts along one of shorter sides 166 and extends inwardly into an interior portion of the second element. When second element 162 is placed in registration atop rectangular portion 152 and the two pieces are secured to each other, especially using an adhesive, the apertures 168 define a keyway into which an end 142, 144 of the strap 140 can be inserted and also secured by adhesive or the like. In the preferred embodiments, second element 162 has a thickness that is greater than or equal to a thickness of the strap 140. To assist in punching out apertures 168, and to provide a facing surface that promotes the movement of cards, especially the plastic cards thereacross, it may be preferred to use a leather or polymeric material as the second element 162.

Figure 9:
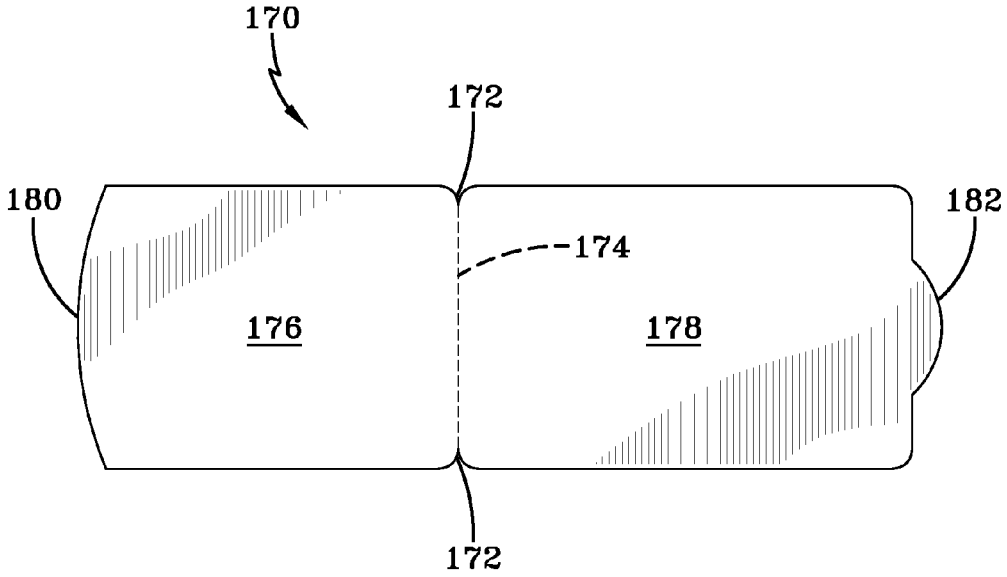
FIG. 9 shows, in top plan view, a tabbed element for holding a card, in an open condition.
Figure 10:
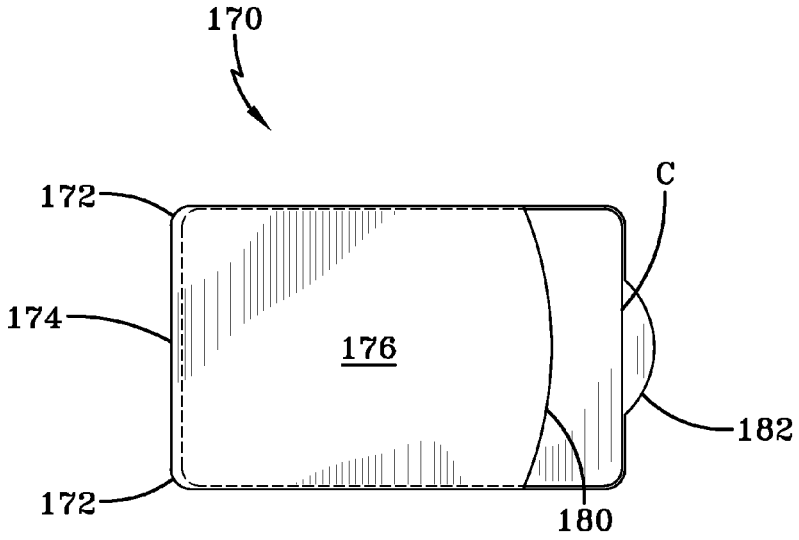
FIG. 10 shows in top plan view, the FIG. 9 tabbed element in a folded condition representing operative engagement with a card.

A further element that may be useful with embodiment of wallet 10,110 is a card retaining element 170. FIGS. 9 and 10 show this element 170 in top plan views, but in FIG. 9, the element is in an opened, isolated condition and in FIG. 10, the element is in folded engagement with an exemplary card C. Card retaining element 170 is preferably formed by cutting, punching or a similar manufacturing method from a planar piece of a thermoplastic material such as a polypropylene. In the illustrated embodiment, card retaining element 170 has a pair of opposing darts or indents 172 that designate a fold line 174 and effectively divide the face of the element into first and second surfaces 176, 178. As best seen in FIG. 10, when the element 170 is folded along fold line 174, a card receiving area is defined by surfaces 176, 178 and fold line 174. A tab 182 at one end of element 170 along am edge of surface 178 extends outwardly from the wallet 10, 110 when inserted therein and may be used to grasp the element, rendering a card held therein readily available. An opposing end 180 remains inside the wallet 10, 110 when the element is inserted. Since the card retaining element 170 has a width that is substantially the same as that of card C, a card retaining element with a card inside slides in and out through the open ends 20, 22 in the same manner as a card would. In addition to facilitating access to the card, the card retaining member also protects a magnetic strip on the card from wear that could occur from repeated sliding contact with other cards in the wallet, by providing a protective surface across the magnetic strip.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A wallet for holding a plurality of rectangular cards, comprising:

a sleeve, flattened into a rectangular profile having a length and a width with the length being larger than the width, the sleeve being open along the width edges and closed along the length edges; and a shaping element, secured to an interior surface of the sleeve for retaining the sleeve in the rectangular profile.

2. The wallet of claim 1, wherein:

the shaping element has a width and length that are approximately identical to a width and length of the rectangular cards being held.

3. The wallet of claim 2, further comprising:

a strap, passing across an exterior surface of the sleeve from one of the width edges to the other width edge, the ends of the strap secured inside the sleeve.

4. The wallet of claim 3, wherein:

the strap comprises a thermoplastic elastomer.

5. The wallet of claim 3, wherein:

the strap ends are secured to at least the shaping element.

6. The wallet of claim 5, further comprising:

a means for securing the strap, formed in the shaping element.

7. The wallet of claim 6, wherein:

the means for securing comprises a shaped keyway in the shaping element and a correspondingly-shaped end of the strap.

8. The wallet of claim 1, wherein:

the sleeve comprises leather.

9. The wallet of claim 1, wherein:

the sleeve comprises a fabric-backed foamed elastomer.

10. The wallet of claim 1, further comprising:

a strap, passing across an exterior surface of the sleeve from one of the width edges to the other width edge, the ends of the strap secured inside the sleeve.

11. The wallet of claim 10, wherein:

the strap comprises a thermoplastic elastomer.

12. The wallet of claim 10, wherein:

the strap ends are secured to at least the shaping element.

13. The wallet of claim 12, further comprising:

a means for securing the strap, formed in the shaping element.

14. The wallet of claim 13, wherein:

the means for securing comprises a shaped keyway in the shaping element and a correspondingly-shaped end of the strap.

15. The wallet of claim 1, further comprising:

means for interfering with transmission of radio frequency signals through the sleeve, incorporated in at least one of the sleeve and the shaping element.

16. The wallet of claim 1, wherein:

the sleeve comprises a rectangular piece of flexible material, folded onto itself such that a pair of opposing edges of the piece are secured in abutting relationship.

17. The wallet of claim 16, wherein:

the opposing edges of the flexible material are adhesively secured to the shaping element in the abutting relationship.

18. The wallet of claim 1, further comprising:

a card retaining element having a tabbed end that extends outwardly from an open end of the sleeve.

* * * * *